US007478796B2

(12) United States Patent
Burkett

(10) Patent No.: US 7,478,796 B2
(45) Date of Patent: Jan. 20, 2009

(54) GUARDRAIL SUPPORT MEMBERS

(75) Inventor: Michael J. Burkett, Berlin Heights, OH (US)

(73) Assignee: Monroeville Industrial Moldings, Inc., Monroeville, OH (US)

( * ) Notice: Subject to any disclaimer, the term of this patent is extended or adjusted under 35 U.S.C. 154(b) by 350 days.

(21) Appl. No.: 11/150,009

(22) Filed: Jun. 10, 2005

(65) Prior Publication Data

US 2005/0274939 A1 Dec. 15, 2005

Related U.S. Application Data

(60) Provisional application No. 60/578,574, filed on Jun. 10, 2004.

(51) Int. Cl.
*A01K 3/00* (2006.01)

(52) U.S. Cl. ..... 256/13.1

(58) Field of Classification Search ..... 256/13.1; D25/113, 118; 404/6–10
See application file for complete search history.

(56) References Cited

U.S. PATENT DOCUMENTS

| | | | | |
|---|---|---|---|---|
| 1,625,716 | A * | 4/1927 | Edwards | 256/13.1 |
| 1,922,878 | A | 8/1933 | Boyle | |
| 2,056,842 | A | 10/1936 | Edgecomb | |
| 2,123,414 | A | 7/1938 | Gilmore | |
| 2,603,455 | A | 7/1952 | Welch | |
| 2,701,127 | A | 2/1955 | Elliott | |
| 3,317,189 | A | 5/1967 | Rubenstein | |
| 3,360,244 | A | 12/1967 | Bucher | |
| 3,493,213 | A | 2/1970 | Ackerman | |
| 3,591,144 | A | 7/1971 | Iving | |
| 3,603,562 | A | 9/1971 | Glaesener | |
| 3,704,861 | A | 12/1972 | Glaesener | |
| 3,784,167 | A | 1/1974 | Glaesener | |
| 3,825,218 | A | 7/1974 | Krumbein et al. | |
| 3,825,229 | A | 7/1974 | Bartlett et al. | |
| 3,963,218 | A | 6/1976 | Glaesener | |
| 3,975,068 | A | 8/1976 | Speckin | |
| 3,982,735 | A | 9/1976 | Fornells | |
| 4,047,701 | A | 9/1977 | Glaesener | |
| 4,063,713 | A | 12/1977 | Anolick et al. | |
| 4,090,694 | A | 5/1978 | Vincent | |
| 4,138,093 | A | 2/1979 | Meinzer | |
| 4,298,075 | A | 11/1981 | Sweeney | |
| 4,312,600 | A | 1/1982 | Schaaf et al. | |
| 4,329,800 | A | 5/1982 | Shuman | |
| 4,406,563 | A | 9/1983 | Urlberger | |
| 4,553,875 | A | 11/1985 | Casey | |
| 4,684,107 | A | 8/1987 | Robbins, Jr. | |

(Continued)

OTHER PUBLICATIONS http://www.mondopolymer.com/; Jun. 1, 2005, 1 page.

*Primary Examiner*—Victor MacArthur
(74) *Attorney, Agent, or Firm*—Pearne & Gordon LLP

(57) ABSTRACT

A support member for supporting a guardrail with respect to a support post is provided. The support member comprises a body including a first portion adapted to engage a mounting area of a support post and a second portion adapted to engage a mounting area of a guardrail. The first portion comprises a mounting surface that is substantially concave from a first side to a second side of the mounting surface. The first side is provided with a first mounting protrusion and the second side is provided with a second mounting protrusion. Guardrail assemblies including a support member and methods are further provided.

22 Claims, 4 Drawing Sheets

U.S. PATENT DOCUMENTS

| | | | |
|---|---|---|---|
| 4,739,971 | A | 4/1988 | Ruane |
| 4,986,694 | A | 1/1991 | Delamere |
| 5,069,576 | A | 12/1991 | Pomero |
| 5,078,538 | A | 1/1992 | Montalbano |
| 5,152,507 | A | 10/1992 | Lee |
| 5,195,727 | A | 3/1993 | Liao et al. |
| 5,197,819 | A | 3/1993 | Hughes |
| 5,203,543 | A | 4/1993 | Fleury |
| 5,219,241 | A | 6/1993 | Picton |
| 5,261,647 | A | 11/1993 | Venegas, Jr. et al. |
| 5,277,516 | A | 1/1994 | Strieter |
| 5,284,236 | A | 2/1994 | Ohta et al. |
| 5,336,016 | A | 8/1994 | Baatz |
| 5,402,987 | A | 4/1995 | Duyck et al. |
| 5,429,449 | A | 7/1995 | Baatz |
| 5,503,496 | A | 4/1996 | Voigt |
| 5,507,473 | A | 4/1996 | Hammer et al. |
| 5,601,279 | A | 2/1997 | Schwartz et al. |
| 5,657,966 | A | 8/1997 | Cicinnati |
| 5,667,335 | A | 9/1997 | Khieu et al. |
| 5,727,762 | A | 3/1998 | Cosentino |
| 5,791,811 | A | 8/1998 | Yoshino |
| 5,794,897 | A | 8/1998 | Jobin et al. |
| 5,902,067 | A | 5/1999 | Rushing |
| 6,007,269 | A | 12/1999 | Marinelli |
| 6,010,275 | A | 1/2000 | Fitch |
| 6,036,399 | A | 3/2000 | Schalk |
| 6,168,346 | B1 | 1/2001 | Ernsberger |
| 6,179,279 | B1 | 1/2001 | Asai et al. |
| 6,220,576 | B1 | 4/2001 | Chan |
| 6,308,936 | B1 | 10/2001 | Atwood |
| 6,530,560 | B2 | 3/2003 | King |
| 6,561,492 | B1 | 5/2003 | Hubbell |
| 6,758,627 | B2 | 7/2004 | King |
| 2004/0234334 | A1 | 11/2004 | King |

* cited by examiner

GUARDRAIL SUPPORT MEMBERS

CROSS-REFERENCE TO RELATED APPLICATION

This application claims the benefit of U.S. Provisional Application No. 60/578,574, filed Jun. 10, 2004, the entire disclosure which is herein incorporated by reference.

FIELD OF THE INVENTION

The present invention relates to support members, and more particularly, to support members for a guardrail.

BACKGROUND OF THE INVENTION

Vehicle roadways commonly employ a guardrail assembly as a safety barrier for vehicles. Guardrail assemblies are known to include guardrail sections joined together and supported at a predetermined elevation adjacent the roadway surface. Guardrail assemblies commonly include a support assembly to support the guardrail sections at the predetermined elevation. One conventional support assembly includes a cylindrical wooden post and a mounting block for positioning between a guardrail and the cylindrical wooden post. However, certain mounting block structures may not provide a desired level of stability at the interface between the mounting block and cylindrical wooden post.

SUMMARY OF THE INVENTION

Accordingly, it is an aspect of the present invention to obviate problems and shortcomings of conventional mounting blocks.

In accordance with one aspect, a support member for supporting a guardrail with respect to a support post is provided. The support member comprises a body including a first portion adapted to engage a mounting area of a support post and a second portion adapted to engage a mounting area of a guardrail. The first portion comprises a mounting surface that is substantially concave from a first side to a second side of the mounting surface. The first side is provided with a first mounting protrusion and the second side is provided with a second mounting protrusion.

In accordance with another aspect, a guardrail assembly comprises a support post including an outer surface with a substantially convex mounting area. The guardrail assembly further includes a guardrail with a mounting area and a support member mounted between the substantially convex mounting area of the support post and the mounting area of the guardrail. The support member includes a mounting surface that is substantially concave from a first side to a second side of the mounting surface. The first side is provided with a first mounting protrusion and the second side is provided with a second mounting protrusion. At least a portion of the substantially concave mounting surface of the support member engages at least a portion of the substantially convex mounting area of the support post with the first and second mounting protrusions engaging the support post and straddling the substantially convex mounting area of the support post.

In accordance with still another aspect, a method of providing a guardrail assembly is provided. The method includes the steps of providing a support post including an outer surface with a substantially convex mounting area and an aperture extending through the substantially convex mounting area. The method further includes the step of providing a guardrail including a mounting area and an aperture extending through the mounting area. The method still further includes the step of providing a support member comprising a mounting surface that is substantially concave from a first side to a second side of the mounting surface. An aperture extends through the substantially concave mounting surface and the first side is provided with a first mounting protrusion and the second side is provided with a second mounting protrusion. The method also includes the step of providing a fastener device including a first end portion, a second end portion, and an intermediate portion. The method further includes the step of positioning the support member with respect to the support post such that the first and second mounting protrusions engage the support post and straddle the substantially convex mounting area of the support post. The method further includes the step of positioning the intermediate portion of the fastener device through the aperture of the support post, the aperture of the support member and the aperture of the guardrail. The method also includes the step of tightening the fastener device wherein at least a portion of the substantially concave mounting surface of the support member engages at least a portion of the substantially convex mounting area of the support post.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
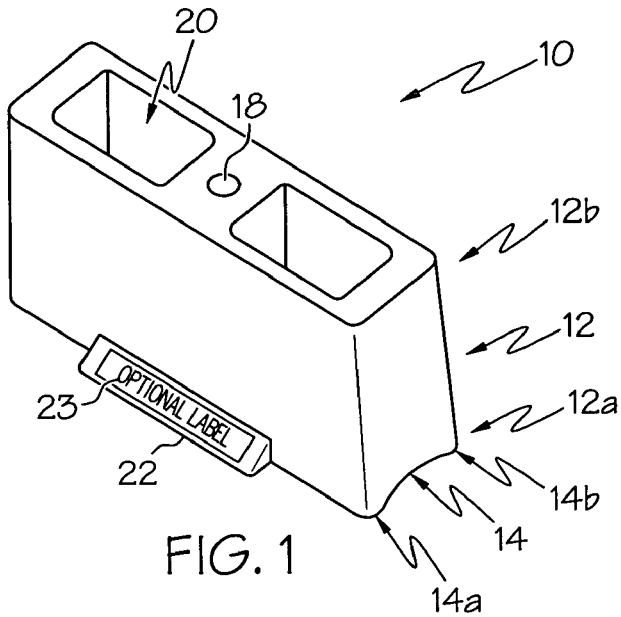
FIG. 1 is a perspective view of a support member in accordance with an exemplary embodiment of the present invention.

Certain terminology is used herein for convenience only and is not to be taken as a limitation on the present invention. Further, in the drawings, the same reference numerals are employed for designating the same elements.

FIG. 1 illustrates a perspective view of a support member 10 in accordance with one exemplary embodiment of the present invention. Support members of the present invention may comprise a wide range of structural configurations adapted to support a guardrail with respect to a support post. For example, the support member may comprise a support block, a beam, lattice structure or other member sufficient to provide a supporting function. For example, as shown, the support member 10 can include a body 12 with a first portion 12*a* adapted to engage a mounting area of a support post and a second portion 12*b* adapted to engage a mounting area of a guardrail. The first portion comprises a mounting surface 14 that is substantially concave from a first side 14*a* to a second side 14*b* of the mounting surface.

A wide variety of concave mounting surfaces may be used in accordance with aspects of the present invention. In the illustrated example, the substantially concave mounting surface 14 is cylindrically concave to provide an elongated concave cavity for receiving a substantially convex area of an elongated cylindrical member. Although not shown, the substantially concave mounting surface may be spherically concave to provide a concave cavity for receiving a substantially convex surface of a spherical member. In further examples, the substantially concave mounting surface may have other concave shapes to receive a convex area of members having a conical, elliptical or other shape. Although not necessary, the illustrated substantially concave mounting surface 14 can include a radius "R" from the first side 14*a* to the second side 14*b*. The value of "R" can have a wide variety of ranges depending on the particular example. For instance, the substantially concave mounting surface 14 may comprise a cylindrically concave mounting surface having a radius "R" from about 6 inches to about 8 inches. In another example, a cylindrically concave mounting surface may be provided with a radius "R" from about 6½ to about 7½ inches, such as about 7 inches.

In certain examples, the substantially concave mounting surface may be continuously concave such that the surface is concave at each position along the surface from the first side to the second side of the substantially concave mounting surface. In further examples, it is contemplated that the substantially concave mounting surface may comprise at least one substantially nonconcave portion, such as a nonconcave segment. For example, a plurality of nonconcave segments, such as planar segments, may approximate a curved surface such that the mounting surface comprises a substantially concave mounting surface.

Figure 2:
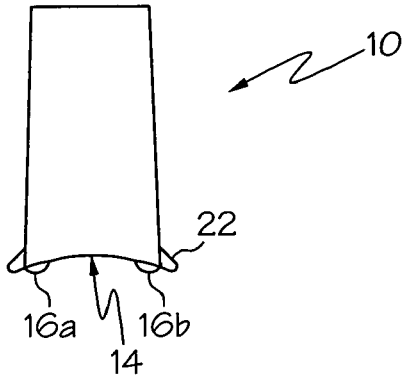
FIG. 2 is a side elevational view of the support member of FIG. 1.
Figure 3:
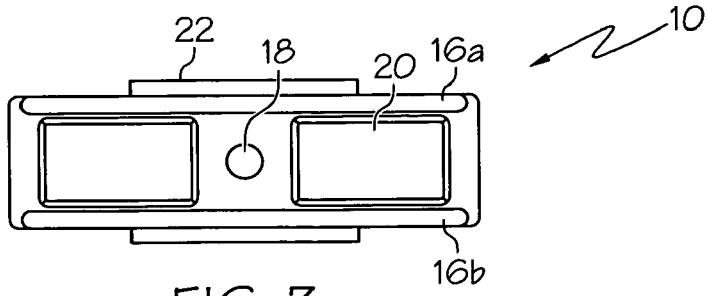
FIG. 3 is a bottom view of the support member of FIG. 1.
Figure 4:
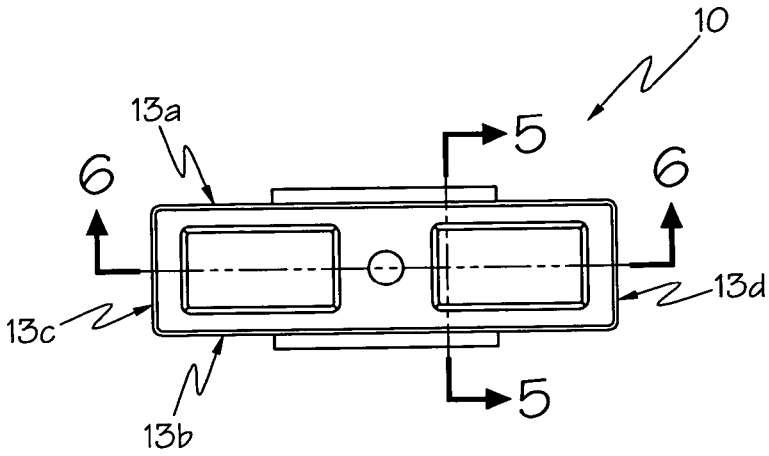
FIG. 4 is a top view of the support member of FIG. 1.
Figure 5:
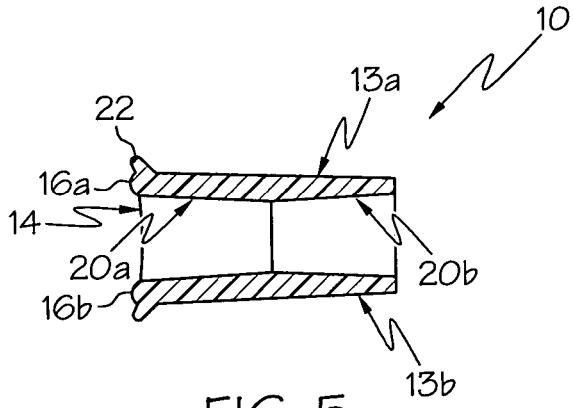
FIG. 5 is as sectional view of the support member along line 5-5 of FIG. 4.
Figure 6:
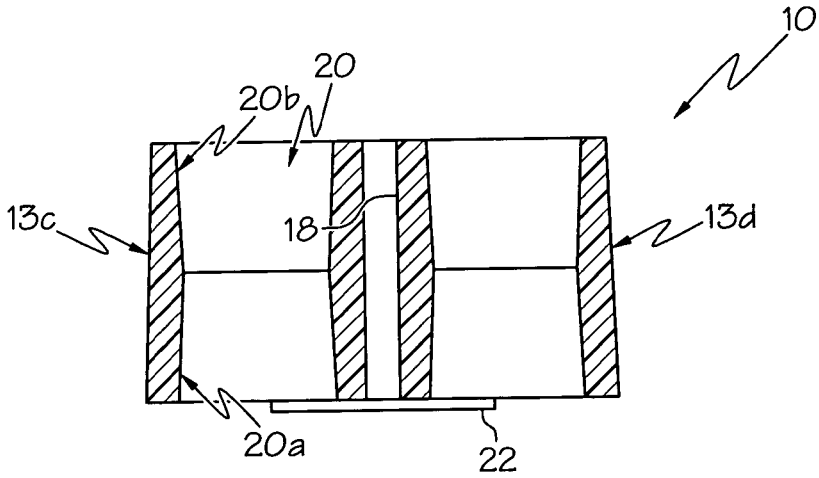
FIG. 6 is a sectional view of the support member along line 6-6 of FIG. 4.

Support members in accordance with the present invention further include mounting protrusions provided at respective sides of the mounting surface. For example, as shown in FIGS. 2, 3 and 5, the first side 14*a* of the substantially concave mounting surface 14 is provided with a first mounting protrusion 16*a* and the second side 14*b* of the substantially concave mounting surface 14 is provided with a second mounting protrusion 16*b*. The mounting protrusions 16*a*, 16*b* are adapted to provide further stability to the support member by straddling a substantially convex mounting area of the support post.

Mounting protrusions can be positioned at various locations and may be of any size, shape or configuration to achieve increased stability at the interface between the support member and the support post. For example, protrusion configurations may be, but are not limited to, vertical, horizontal, diagonal, diamond shaped, circular or any configuration which provides for increased stability.

As shown in FIG. 3, the mounting protrusions 16*a*, 16*b* may comprise a pair of elongated ribs. Providing the mounting protrusions as elongated ribs can allow continuous contact between the mounting protrusions and a length of a mounting area of a support post. It is also contemplated that the first mounting protrusion and the second mounting protrusion may each comprise a plurality of members. For example, each mounting protrusion may be broken along the length of the protrusion, thereby forming a plurality of members, such as segments, extending along a length of the body. Still further, the plurality of members may comprise pointed or rounded protrusions forming cleats to facilitate relatively high stress contact and/or embedding with the mounting area of the support post.

Although not necessary, the mounting protrusions can also be oriented substantially parallel with respect to one another. For example, as shown in FIG. 3, the first and second protrusions 16*a*, 16*b* comprise elongated ribs that are substantially parallel with respect to one another. Orienting the protrusions substantially parallel with respect to one another may facilitate mounting with respect to a mounting area of a cylindrical support post. However, it is contemplated that further embodiments may include first and second protrusions that are oriented in a nonparallel relationship. For example, the protrusions may be provided with a converging orientation to facilitate engagement with a mounting area of a conically shaped support post.

The support member 10 can also include an optional aperture 18 to accommodate a fastening device that might be used to facilitate connection of the guardrail to the support post. As shown, aperture 18 extends through the substantially concave mounting surface 14 from the first portion 12*a* to the second portion 12*b* of the body 12. While a single aperture 18 is illustrated, it is contemplated that the support member 10 may include a plurality of apertures in additional embodiments. Moreover, while the single aperture 18 is shown centrally located with respect to the body 12, it is contemplated that further embodiments may include one or more apertures that are not centrally located with respect to the body.

As shown, the support member 10 may also include one or more optional wings 22 or other members adapted to display a label 23 including indicia to communicate instructions, company information, product information or other information to an individual observing the support member 10.

Support members may be formed from polymers, polymeric blends, or other materials. In one example, the support member may be formed with a polymer processing technology such as an injection molding process. The body may be at least partially hollow in order to conserve material and facilitate solidification of the body 12 within the mold during an injection molding process. For example, as shown the body includes first and second cavities 20 positioned about the aperture 18. The cavities 20 are shown to include a first portion 20*a* and a second portion 20*b* that are provided with a draft wherein apposed sides of the cavities are slightly tapered with respect to one another to facilitate removal of a mold insert. As shown, the outer sides of the body can further include a draft to facilitate injection of the body from the mold. For examples, as shown, the body includes a first side 13*a* and a second side 13*b* that are slightly angled with respect to one another and a third side 13*c* and a fourth side 13*d* are slightly angled with respect to one another.

Figure 8:
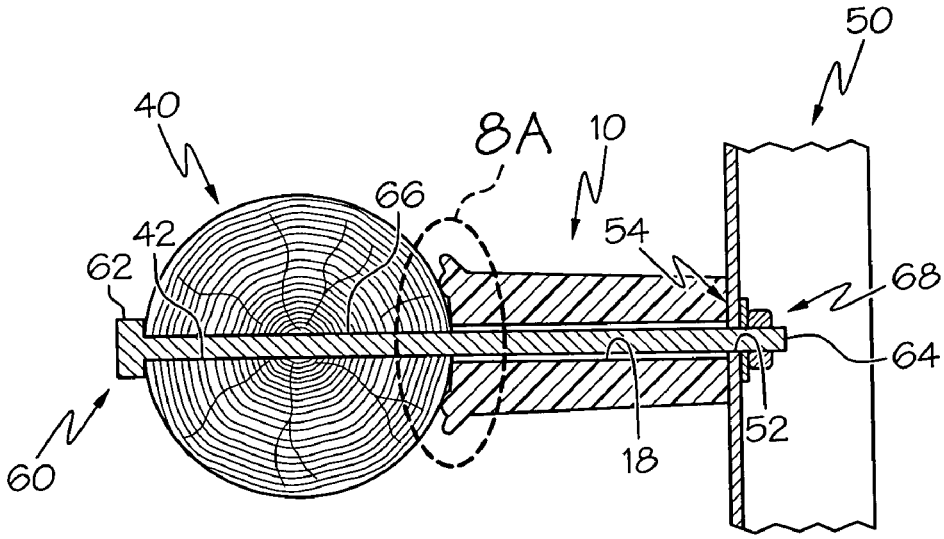
FIG. 8 is a sectional view of the guardrail assembly along line 8-8 of FIG. 7.

As shown in FIG. 8, a guardrail assembly 30 may include a support member 10 mounted between a substantially convex mounting area 44 of a support post 40 and a mounting area 54 of a guardrail 50. As shown, the support post 40 can comprise an outer surface including the substantially convex mounting area 44. In the illustrated example, the entire outer surface may be substantially convex to form a cylindrical support post having a circular cross section. In further embodiments, it is understood that the support post may have other features or constructions while incorporating aspects of the present invention. Certain support posts may incorporate material that is resistant to compression. In further example embodiments, the support post is comprised of a material that can be compressed, such as crushed or otherwise deformed. The illustrated embodiment depicts a support post 40 comprised of wood that has an outer surface that may be deformed under sufficient bearing stress conditions. In accordance with exemplary embodiments, the support post may include an aperture 42 to accommodate a fastening device that might be used to facilitate connection of the guardrail to the support post.

As further shown, the guardrail assembly 30 further comprises a guardrail 50. While a single guardrail 50 is illustrated, it is contemplated that a plurality of guardrails may be provided in accordance with aspects of the present invention. In accordance with one aspect, the guardrail may comprise a plurality of segments having end portions that overlap. Therefore, the guardrail assembly may include a plurality of guardrail members that have overlapped end portions that are simultaneously fastened with respect to one another and with respect to the support post by way of a fastening device. In accordance with exemplary embodiments, the support post may include a mounting area 54 and an aperture 52 extending through the mounting area to accommodate a fastening device that might be used to facilitate connecting of the guardrail to the support post. The guardrail may comprise a wide variety of materials and constructions to provide a barrier function.

Figure 7:
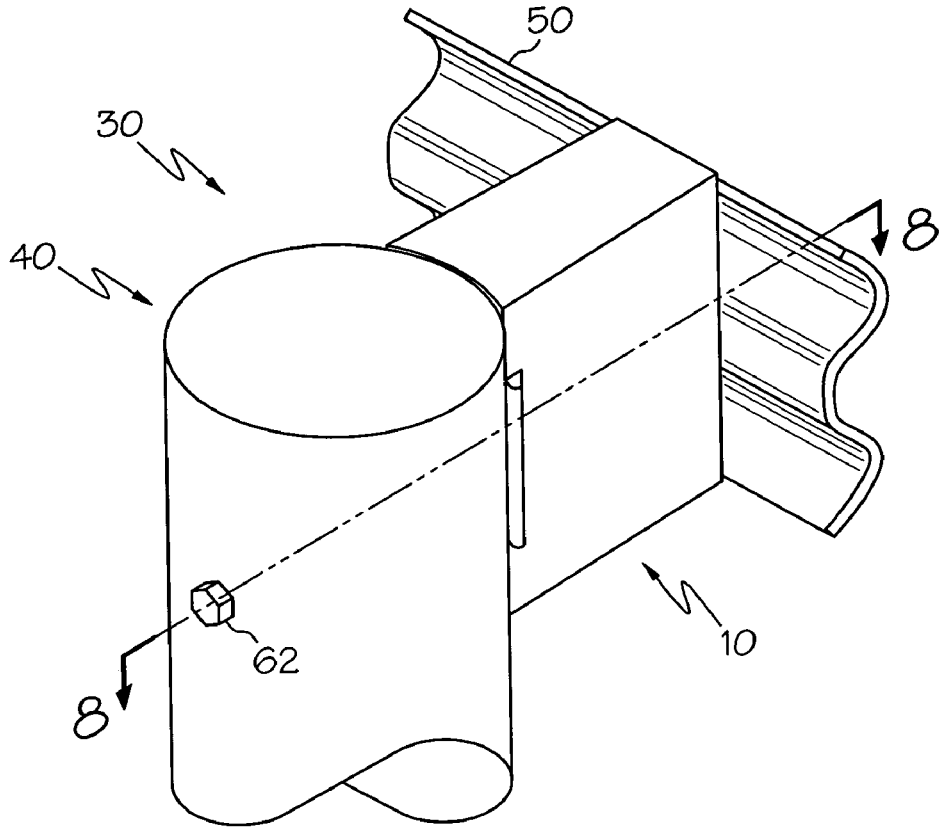
FIG. 7 is a perspective view of a guardrail assembly incorporating the support member of FIG. 1.

A fastening device may be used to mount the support member 10 between the substantially convex mounting area 44 of the support post 40 and a mounting area 54 of the guardrail 50. Fastening devices may be provided that loop around portions of the support post and guardrail. In further examples, fastening devices may comprise one or more nut and bolt arrangements. For example, as shown in FIGS. 7 and 8, the fastener device 60 comprises a bolt including a first end portion 62, a second end portion 64 and an intermediate portion 66. The intermediate portion 66 of the bolt can be passed through the aperture 42 of the support post 40, the aperture 18 of the support member 10, and the aperture 52 of the guardrail 50. A nut 68 may then be threaded on the second end portion 64 of the bolt to mount the support member relative to the support post and guardrail.

Figure 8A:
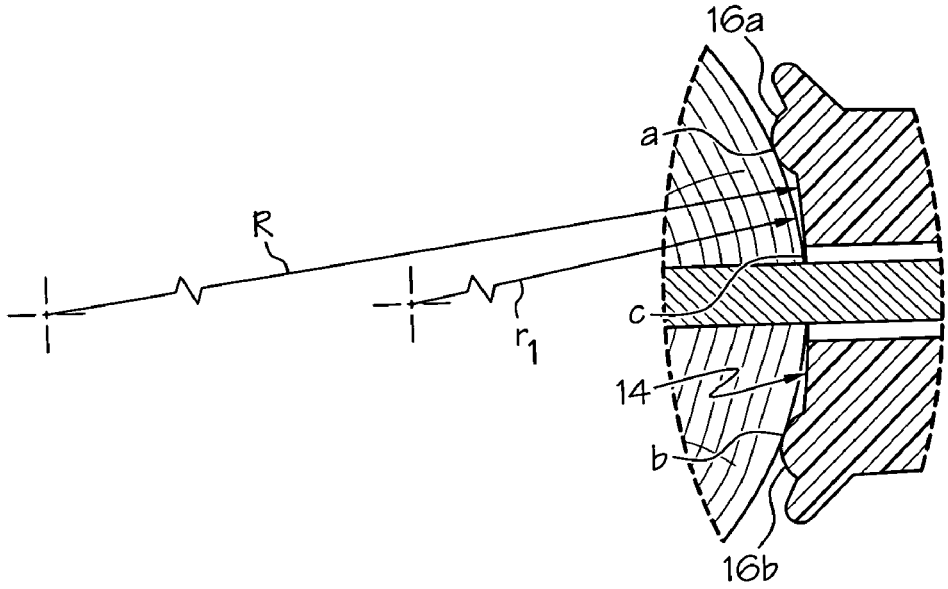
FIG. 8A is an enlarged partial sectional view of portions of the guardrail assembly taken at view 8A of FIG. 8.

As best shown in FIG. 8A, the concave mounting surface 14 may be formed with a radius "R" that is greater than an undeformed radius "$r_1$" of the support post 40. Providing a radius "R" that is sufficiently greater than the undeformed radius "$r_1$" of the support post 40 can allow contact between the support member 10 and the support post 40 at three distinct locations. For instance, as shown in FIG. 8A, the first mounting protrusion 16*a* contacts the substantially convex mounting area 44 at a first contact location "a" while the second mounting protrusion 16*b* contacts the substantially convex mounting area 44 at a second contact location "b". Still further, at least a portion of the substantially concave mounting surface 14 can contact at least a portion of the substantially convex mounting area 44 at a third contact location "c" with the first and second protrusions 16*a*, 16*b* straddling the substantially convex mounting area 44 of the support post 40. Providing contact between the support member 10 and the support post 40 at three distinct locations can enhance stability between the support post 40 and the support member 10 by inhibiting, such as preventing, undesirable pivoting between the support member 10 and the support post 40.

Although not shown, in further examples, only the first and second mounting protrusions 16*a*, 16*b* contact the support post 40 at two distinct locations. It is further contemplated that, in such an optional embodiment, the support member 10 and support post 40 may be designed to eventually achieve a three point contact after sufficiently tightening the fastener device 60. For example, the fastener device 60 may be sufficiently tightened such that the first and second mounting protrusions 16*a*, 16*b* are at least partially embedded within the support post 40 until the substantially concave mounting surface 14 engages the substantially convex mounting area 44 of the support post 40 to achieve the three point contact arrangement.

Figure 8B:
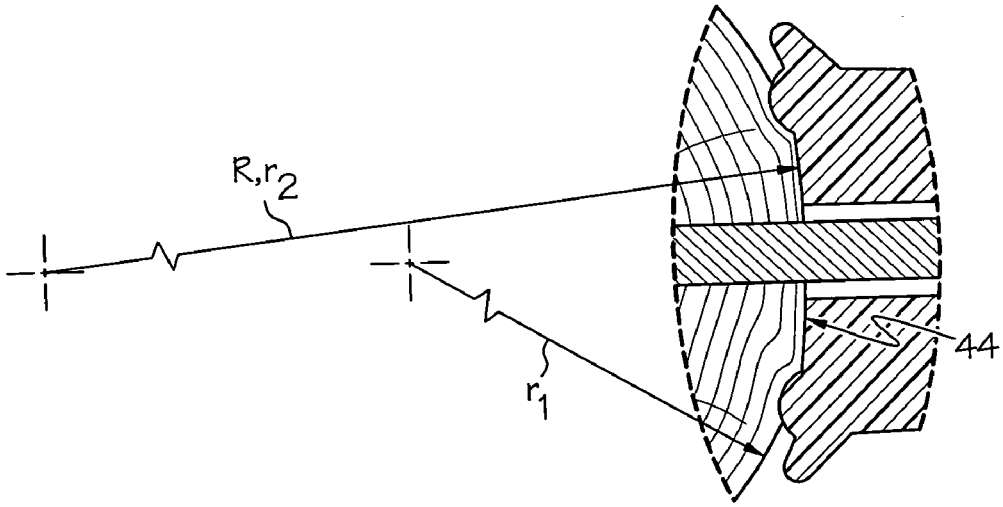
FIG. 8B is another enlarged partial sectional view similar to FIG. 8A, and further illustrating first and second protrusions being partially embedded within a support post.

Although not required, the fastener device 60 may still be further tightened such that at least a portion of the substantially convex mounting area 44 of the support post conforms to the shape of the concave mounting surface 14 of the support member 10. For example, as shown in FIG. 8B, the fastener device 60 is sufficiently tightened such that an area of the support post 40 is compressed wherein the compressed area of the support post achieves a radius "$r_2$" that is substantially equal to the radius "R" of the concave mounting surface 14. In the illustrated example shown in FIG. 8B, the entire substantially convex mounting area 44 is conformed to the shape of the substantially concave mounting surface 14 of the support member 10. In further examples, only a portion of the substantially convex mounting area 44 conforms with the shape of the substantially concave mounting surface 14.

From the above description of the invention, those skilled in the art will perceive improvements, changes and modifications. Such improvements, changes and modifications within the skill of the art are intended to be covered by the appended claims.

What is claimed:

1. A support member for supporting a guardrail with respect to a support post, the support member comprising:

a body including a first portion adapted to engage a mounting area of a support post and a second portion adapted to engage a mounting area of a guardrail, the first portion comprising a cylindrical mounting surface that is cylindrically concave from a first side to a second side of the mounting surface, wherein the first side is provided with a first mounting protrusion which is integral with the cylindrically concave mounting surface and the second side is provided with a second mounting protrusion which is integral with the cylindrically concave mounting surface and wherein each mounting protrusion which is integral with the cylindrically concave mounting surface extends away from the cylindrically concave mounting surface in a direction of the cylindrically concave mounting surface; wherein the first mounting protrusion comprises a first vertically elongated rib and the second mounting protrusion comprises a second vertically elongated rib.

2. The support member of claim 1, wherein the body includes an aperture extending through the concave mounting surface from the first portion to the second portion of the body.

3. The support member of claim 1, wherein the first and second vertically elongated ribs are substantially parallel with respect to one another.

4. The support member of claim 1, wherein the cylindrically concave mounting surface extends between the first and second mounting protrusions and outside each of the first and second mounting protrusions.

5. The support member of claim 1, wherein the support member is a support block.

6. The support member of claim 5, wherein the support block is formed from material comprising a polymer.

7. The support member of claim 6, wherein the support block has one or more hollow cavities.

8. A guardrail assembly-comprising:

a support post including an outer surface with a cylindrically convex mounting area;

a guardrail including a mounting area; and a support member configured to support the guardrail with respect to the support post, the support member comprising a body including a first portion adapted to engage the cylindrically convex mounting area of the of the support post and a second portion adapted to engage the mounting area of the guardrail, the first portion comprising a cylindrical mounting surface that is cylindrically concave from a first side to a second side of the mounting surface, wherein the first side is provided with a first mounting protrusion which is integral with the cylindrically concave mounting surface and the second side is provided with a second mounting protrusion which is integral with the cylindrical mounting surface, wherein each mounting protrusion which is integral with the mounting surface extends away from the cylindrically concave mounting surface in a direction of the cylindrically concave mounting surface, and wherein the support member is mounted between the cylindrically convex mounting area of the support post and the mounting area of the guardrail with at least a portion of the cylindrically concave mounting surface of the support member engaging at least a portion of the cylindrically convex mounting area of the support post and with the first and second mounting protrusions straddling the cylindrically convex mounting area of the support post; wherein the first mounting protrusion comprises a first vertically elongated rib and the second mounting protrusion comprises a second vertically elongated rib.

9. The guardrail assembly of claim 8, further comprising a fastener device including a first end portion, a second end portion, and an intermediate portion, wherein the intermediate portion extends through the support post, the support member and the guardrail.

10. The guardrail assembly of claim 8, wherein the cylindrically concave mounting surface extends between the first and second mounting protrusions and outside each of the first and second mounting protrusions.

11. A guardrail assembly comprising:

a support post including an outer surface with a cylindrically convex mounting area;

a guardrail including a mounting area; and a support member mounted between the cylindrically convex mounting area of the support post and the mounting area of the guardrail, the support member including a mounting surface that is cylindrically concave from a first side to a second side of the mounting surface, wherein the first side is provided with a first mounting protrusion which is integral with the cylindrical mounting surface and the second side is provided with a second mounting protrusion which is integral with the cylindrical mounting surface, wherein each mounting protrusion which is integral with the cylindrical mounting surface extends away from the cylindrically concave mounting surface in a direction of the cylindrically concave mounting surface, and wherein at least a portion of the cylindrically concave mounting surface of the support member engages at least a portion of the cylindrically convex mounting area of the support post with the first and second mounting protrusions engaging the support post and straddling the cylindrically convex mounting area of the support post; wherein the first mounting protrusion comprises a first vertically elongated rib and the second mounting protrusion comprises a second vertically elongated rib.

12. The guardrail assembly of claim 11, further comprising a fastener device adapted to fasten the guardrail with respect to the support post.

13. The guardrail assembly of claim 12, wherein a first aperture extends through the support post, a second aperture extends through the support member and a third aperture extends through the guardrail, and wherein an intermediate portion of the fastener device extends through the first, second, and third apertures.

14. The guardrail assembly of claim 11, wherein the first and second vertically elongated ribs are parallel with respect to one another.

15. The guardrail assembly of claim 11, wherein the first and second mounting protrusions are at least partially embedded within the support post.

16. The guardrail assembly of claim 11, wherein the cylindrically concave mounting surface of the support member includes a first radius and the cylindrically convex mounting area of the support post includes a second radius.

17. The guardrail assembly of claim 16, wherein the first radius is greater than or equal to the second radius.

18. The guardrail assembly of claim 17, wherein the first radius is greater than the second radius prior to mounting the support member between the cylindrically convex mounting area of the support post and the mounting area of the guardrail.

19. The guardrail assembly of claim 18, wherein the first radius is equal to the second radius after mounting the support member between the cylindrically convex mounting area of the support post and the mounting area of the guardrail.

20. The guardrail assembly of claim 17, wherein the first radius is equal to the second radius after mounting the support member between the cylindrically convex mounting area of the support post and the mounting area of the guardrail.

21. The support member of claim 16, wherein the first radius is from about 6.5 inches to about 7.5 inches.

22. The guardrail assembly of claim 11, wherein the cylindrically concave mounting surface extends between the first and second mounting protrusions and outside each of the first and second mounting protrusions.

* * * * *

UNITED STATES PATENT AND TRADEMARK OFFICE

CERTIFICATE OF CORRECTION

PATENT NO. : 7,478,796 B2
APPLICATION NO. : 11/150009
DATED : January 20, 2009
INVENTOR(S) : Michael J. Burkett It is certified that error appears in the above-identified patent and that said Letters Patent is hereby corrected as shown below:

In claim 14, column 8, line 23, please insert the word --substantially-- after the word "are" and before the word "parallel".

In claim 19, column 8, line 40, please insert the word --substantially-- after the word "is" and before the word "equal".

In claim 20, column 8, line 44, please insert the word --substantially-- after the word "is" and before the word "equal".

Signed and Sealed this

Seventeenth Day of March, 2009

JOHN DOLL
*Acting Director of the United States Patent and Trademark Office*